US005457906A

United States Patent [19]

Mosher, Jr.

[11] Patent Number: 5,457,906

[45] Date of Patent: Oct. 17, 1995

[54] ADHESIVE CLOSURE FOR IDENTIFICATION BAND AND METHOD

[75] Inventor: Walter W. Mosher, Jr., West Hills, Calif.

[73] Assignee: Precision Dynamics Corporation, San Fernando, Calif.

[21] Appl. No.: 275,318

[22] Filed: Jul. 14, 1994

Related U.S. Application Data

[63] Continuation of Ser. No. 978,880, Nov. 19, 1992, abandoned.

[51] Int. Cl.[6] ..... A44C 5/00

[52] U.S. Cl. ..... 40/633; 40/630; 283/81; 428/40; 428/202; 428/352

[58] Field of Search ..... 40/630, 638, 663, 40/665; 283/75, 81; 428/40, 202, 352; 63/3, DIG. 1, DIG. 3; 24/16 PB, 30.5 P, 304, DIG. 11

[56] References Cited

U.S. PATENT DOCUMENTS

| | | | |
|---|---|---|---|
| 3,153,869 | 10/1964 | Twentier | 40/633 |
| 3,197,899 | 8/1965 | Twentier | 40/633 |
| 3,279,107 | 10/1966 | Baumgartner . | |
| 4,420,519 | 12/1983 | Slemmons | 428/352 X |
| 4,624,875 | 11/1986 | Watanabe et al. | 428/202 X |
| 4,682,431 | 7/1987 | Kowalchuk | 40/633 |
| 4,914,843 | 4/1990 | DeWoskin | 40/633 |
| 4,991,337 | 2/1991 | Solon | 40/633 |

OTHER PUBLICATIONS

Mark–Clark, Soft Lock Brochure.
Products International, Tab Bands Brochure.

*Primary Examiner*—Brian K. Green
*Attorney, Agent, or Firm*—Thomas P. Mahoney; J. Mark Holland

[57] ABSTRACT

An identification bracelet includes a shield or cover such as a liner affixed thereto. The bracelet includes an adhesive closure acting between the ends of the bracelet to maintain the bracelet in a desired encircling relationship about an object, and the cover prevents the premature exposure and attachment of the adhesive. In an alternative embodiment, the shield includes a bonding strip to accomplish the relatively permanent affixation of the shield to the bracelet. The shield preferably includes a non-adhesive surface on the portion of the shield that confronts the adhesive prior to engaging the bracelet about the object to be identified.

4 Claims, 3 Drawing Sheets

ADHESIVE CLOSURE FOR IDENTIFICATION BAND AND METHOD

This application is a continuation of U.S. application Ser. No. 07/978,880, filed on Nov. 19, 1992, now abandoned.

BACKGROUND OF THE INVENTION

This invention relates to closures for identification bands, and specifically to an improved adhesive closure.

The use of identification bracelets is substantial, both in traditional areas such as hospital patient admissions and in relatively new applications such as crowd control and patron identification. In many such applications, adhesive closure bracelets may be effectively utilized. Such bands typically include an elongated bracelet or strap with an adhesive portion near one end. A disposable, throw-away shield covers the adhesive until just prior to use, at which time the shield is removed from the adhesive and discarded, permitting the ends of the bracelet to be joined to each other.

As indicated, in conventional adhesive closures for identification bands, the shield is separate from the band. Upon the required removal of the shield to expose the adhesive, the shield becomes waste which must be disposed of in some way. Among other things, appropriate disposal (especially in view of the large volumes of bracelets which are frequently used) necessarily requires an increase in the labor associated with use of the bracelet. Additionally, if the shields are not properly disposed of, the separation of the shields from the bands at the point of application can pollute the environment, especially in outdoor applications.

OBJECTS AND ADVANTAGES OF THE INVENTION

It is, therefore, an object of my invention to provide an improved adhesive closure for identification bracelets. In its preferred embodiment, the closure includes adhesive means disposed near one end of the band and adapted to adhesively engage the other end of the band to retain it about an object. The closure further includes shield or cover means such as a liner affixed to the band in a relatively permanent manner. A portion of the shield is adapted to releasably overlie the adhesive prior to use of the band, to prevent inadvertent adhesion of the adhesive. That portion of the shield must be moved or folded out of the way to expose the adhesive, thereby permitting the ends of the band to be adhered to each other. Even during use, however, the shield is not separated from the bracelet but remains attached thereto.

It is a further object of my invention to provide a bracelet having a closure of the aforementioned character, in which the shield liner includes a non-adhesive surface on the overlying portion, whereby the non-adhesive surface overlies and confronts the adhesive means prior to use of the bracelet, permitting the overlying portion of the shield to be moved from the adhesive at the desired time.

Another object of my invention is to provide a bracelet having a closure of the aforementioned character, in which the cover has permanent adhesive means on a portion or edge thereof to accomplish the attachment to the band. For certain methods of manufacture and assembly of the bracelet, such permanent adhesive means on the cover is beneficial and economic as compared to mechanical or other methods of fastening the cover to the band. The permanent adhesive means may include, for example, an adhesive bonding strip.

Thus, the preferred cover liner for the improved closure of my invention includes a permanent adhesive portion to attach the cover to the band, and a portion having a non-adhesive surface to overlie the adhesive on the band itself (which adhesive acts to hold the band in its operative encircling relationship about the object to be identified).

Yet another object of my invention is the provision of an identification band with closure means having no disposable parts. The band has first and second ends adapted to be joined together to encircle an object to be identified, and adhesive means acting between the first and second ends to accomplish that joinder. A cover or shield means is relatively permanently affixed to the band means, and has a portion adapted to temporarily overlie the adhesive means prior to the joinder of the first and second ends of the band. The portion is also adapted to be moved from the overlying relationship to expose the adhesive means and permit the joinder of the first and second ends.

A further object of my invention is the provision of an identification bracelet with cover means relatively permanently affixed to the bracelet, a portion of the cover means overlying an adhesive material on the bracelet prior to use of the bracelet. The overlying portion confronts the adhesive to prevent its premature adhesion to anything, and is adapted to be displaced from the overlying relationship without being removed from the bracelet, thereby exposing the adhesive and permitting the adhesion between the first and second ends of the bracelet.

Other objects and advantages of the invention will be apparent from the following specification and the accompanying drawings, which are for the purpose of illustration only.

DESCRIPTION OF PREFERRED EMBODIMENT

Figure 1:
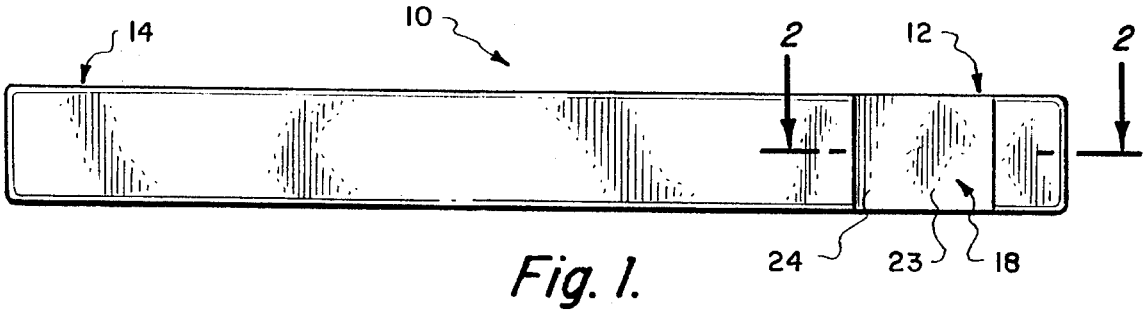
FIG. 1 is a plan view of a preferred embodiment of a bracelet and closure structure in accordance with the teachings of the invention.
Figure 2:
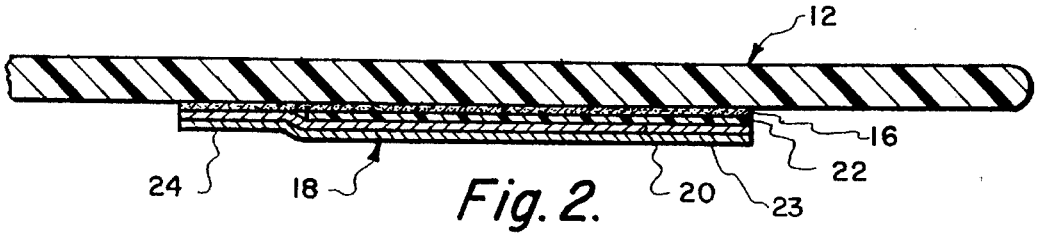
FIG. 2 is a sectional view, taken along line 2—2 of FIG. 1.

Referring to the drawings, and particularly to FIGS. 1–4 thereof, I show an identification bracelet or band 10 having an adhesive closure assembly constructed in accordance with the teachings of the invention. The band is fabricated from plastic or paper or other suitable material, and is adapted to include identifying information thereon or to otherwise serve an identifying function relating to an object or person.

The band 10 includes a first end 12 and a second end 14 remote from the first end 12. The band, and its first and second ends, is sized and shaped so that it can encircle the object to be identified (or, for a further example, encircle a person's wrist) and be usefully retained thereon. In the preferred embodiment, this retention is accomplished by closure means which adhere the first and second ends to each other about the object, as will now be described in further detail.

The first end 12 is provided with adhesive means such as an adhesive layer of material 16. This adhesive is preferably applied across the full width of the bracelet and along a short distance thereof, but those skilled in the art will understand that the particular type, shape and size of the adhesive layer is not critical, so long as it provides sufficient adherence to retain the band about the object to be identified. The adhesive must of course be one which adheres to the particular materials of the bracelet, so that the ends of same can be operatively joined together by the adhesive 16.

The adhesive closure means includes cover means or shield means such as a plastic liner 18. The liner 18 is preferably of the same width as the band 10 and the adhesive 16, but may be of a wide range of sizes and configurations so long as it covers the adhesive 16 prior to use of the bracelet, thereby preventing the premature and undesirable or inadvertent adhesion of the adhesive 16 to an adjacent surface.

Although the cover 18 could be wider than the band 10, it is preferably less than or equal to the band's width for ease of manufacture and handling. Similarly, the cover or shield 18 could be larger than the adhesive means 16 without affecting the efficacy of the closure.

The cover means 18 preferably includes a portion 20 having a non-adhesive surface 22 affixed thereto. The surface 22 may be formed integrally with the cover (or the cover may be fabricated from a suitably non-adhesive material) or may be a separately applied layer or disposition 22 of a material such as silicone, as shown in FIGS. 2–5. Prior to using the bracelet, the non-adhesive surface 22 confronts the adhesive means 16 and prevents the permanent adhesion of the shield means 18 to the adhesive 16. Those skilled in the art will understand that the non-adhesive surface 22 is preferably at least as large as, and is preferably positioned so as to confront the entirety of, the adhesive means 16. Exceptions would include, for example, embodiments in which the adhesive means underlies the affixation portion 24 described below.

The cover means 18 is affixed to the bracelet 10 in a relatively permanent manner, so that it cannot easily be removed from the bracelet. This relatively permanent affixation may be accomplished in a variety of ways, such as by sonic welding, adhesive means, mechanical fastening, heat bonding or the like. In the preferred embodiment illustrated in the drawings, this affixation is provided by the adhesive means 16 contacting an affixation portion 24 of the cover liner 18. Those skilled in the art will understand that, if appropriate materials are utilized for the adhesive 16 and the shield 18, if the adhesive 16 extends under the affixation portion 24, and if the affixation portion 24 does not include a confronting non-adhesive layer such as surface 22, the portion 24 may be sufficiently permanently adhered to the band 10 by simply adhering the portion 24 directly to the adhesive means 16, as illustrated in FIGS. 1–8. To increase the adhesion therebetween, however, a relatively permanent adhesive means such as an adhesive bonding strip 26, FIGS. 9–14, may be provided between the liner 18 and the band 10. The bonding strip 26 can by any of a wide variety of suitable materials and constructions, as will be understood by those skilled in the art.

Figure 3:
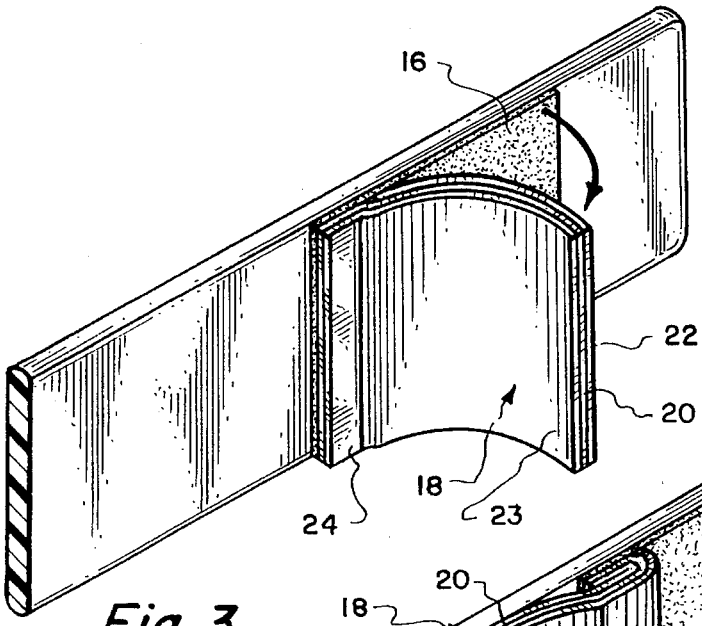
FIGS. 3 and 4 are an isometric views, illustrating the movement of the shield or cover means to expose the underlying adhesive means.
Figure 4:
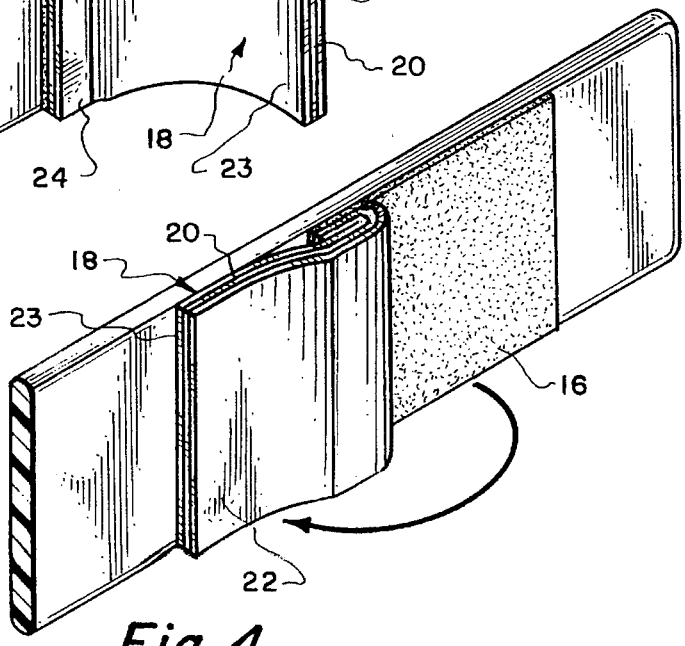
Figure 5:
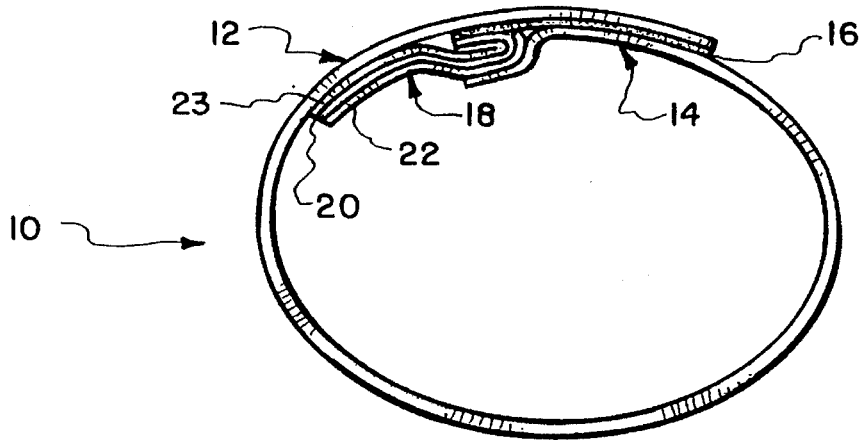
FIG. 5 is a side view of the bracelet as it might be used to encircle an object to be identified.

A preferred use of the bracelet is illustrated in FIGS. 3–5. The shield means 18 is moved from its confronting relationship with the adhesive means 16, and is folded so as to expose the adhesive 16. The shield 18 remains affixed to the band 10, however, through the adhesion of portion 24 to the adhesive means 16. As indicated above, this relatively permanent affixation may be accomplished by other means including mechanical fastening, bonding, or the use of a permanent bonding strip 26 (FIGS. 9–14). The band 10 is then placed about the object to be identified, such as by encircling the bracelet about a person's wrist (not shown), and the second end 14 is brought into relatively permanent adhering relationship with the adhesive means 16, FIG. 5.

The bracelet 10 thereby remains a unitary article, generating no separate refuse to be disposed of at the time the bracelet is applied to the object.

Figure 6:
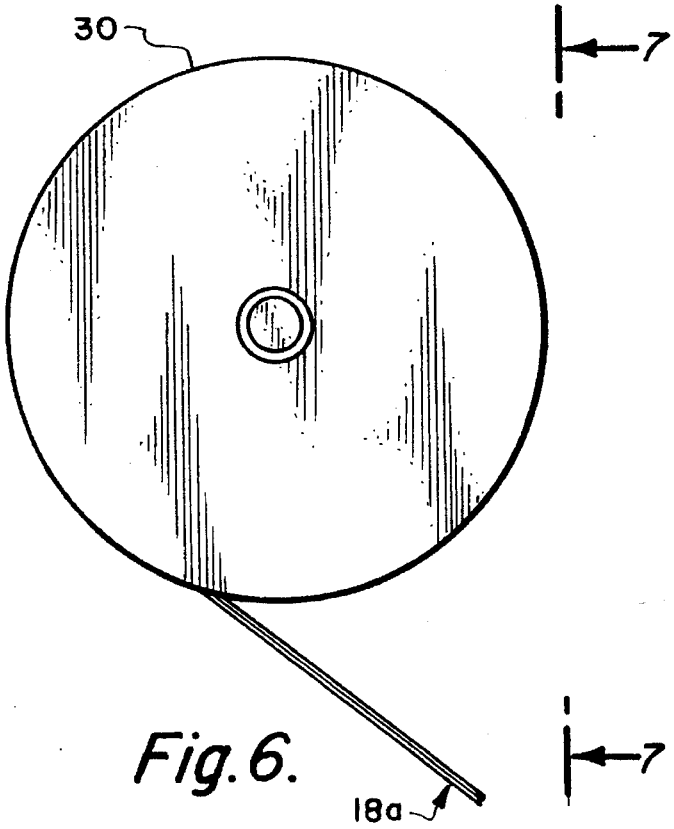
FIG. 6 and 7 are side and front views, respectively of a suitable device for dispensing the shield liner during manufacture and/or assembly of the bracelets.
Figure 7:
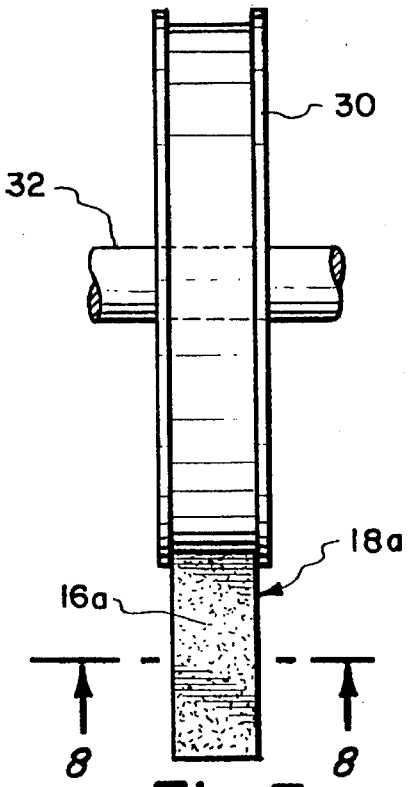
Figure 8:
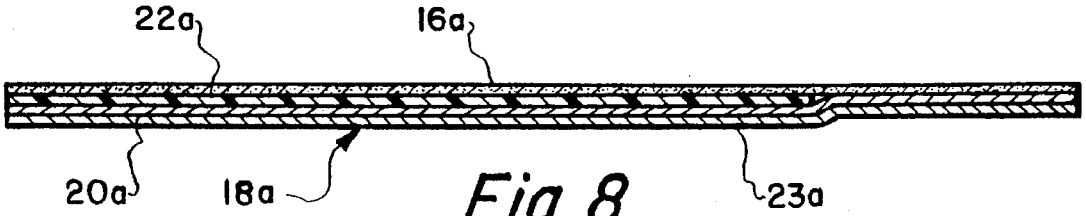
FIG. 8 is a sectional view, taken along line 8—8 of FIG. 7.
Figure 9:
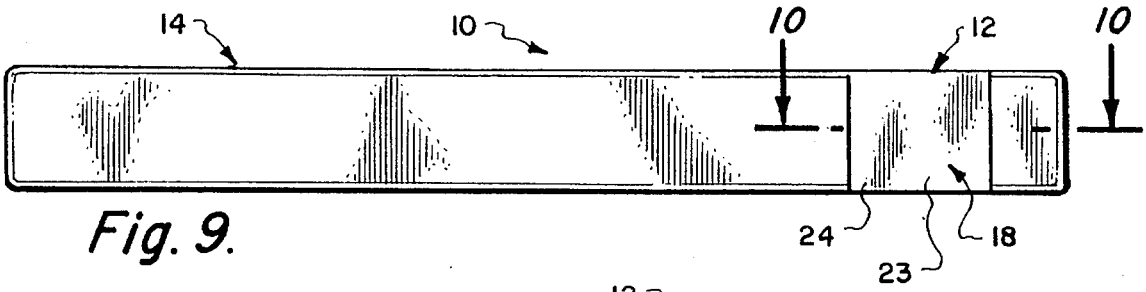
FIGS. 9–12 and 13–14 correspond to FIGS. 1–4 and 7–8 respectively, but illustrate one of the alternative embodiments of the invention in which a permanent adhesive strip is utilized.
Figure 10:
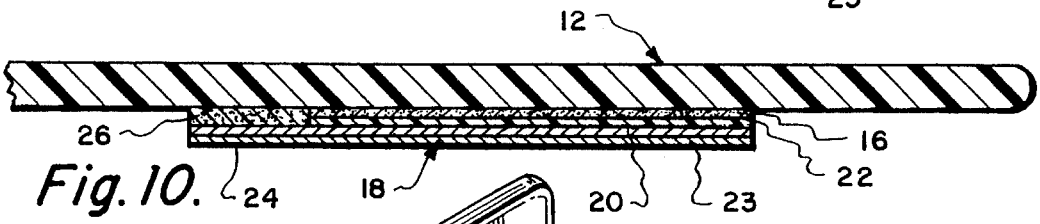
Figure 11:
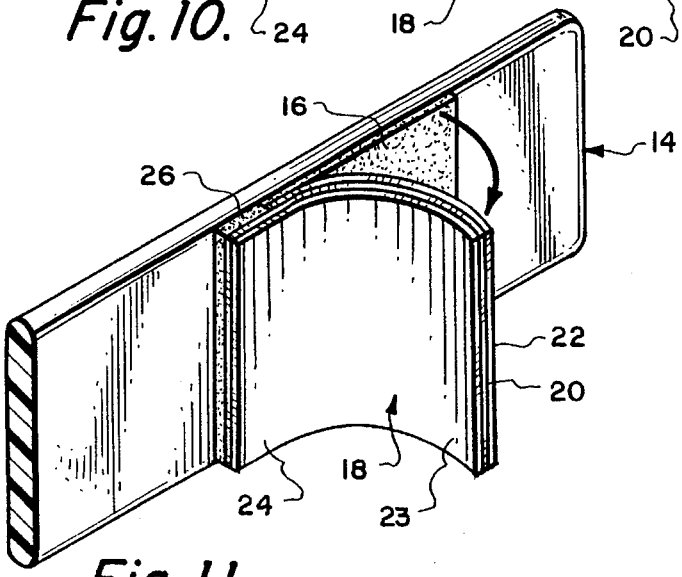
Figure 13:
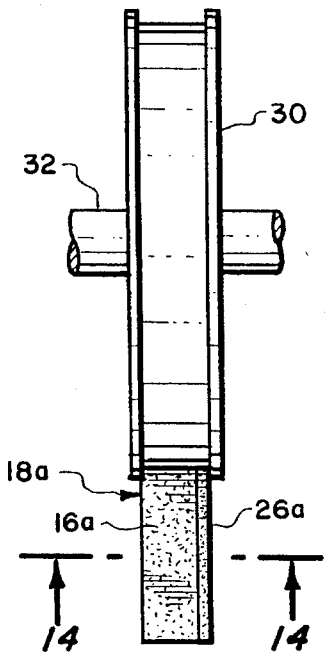
Figure 12:
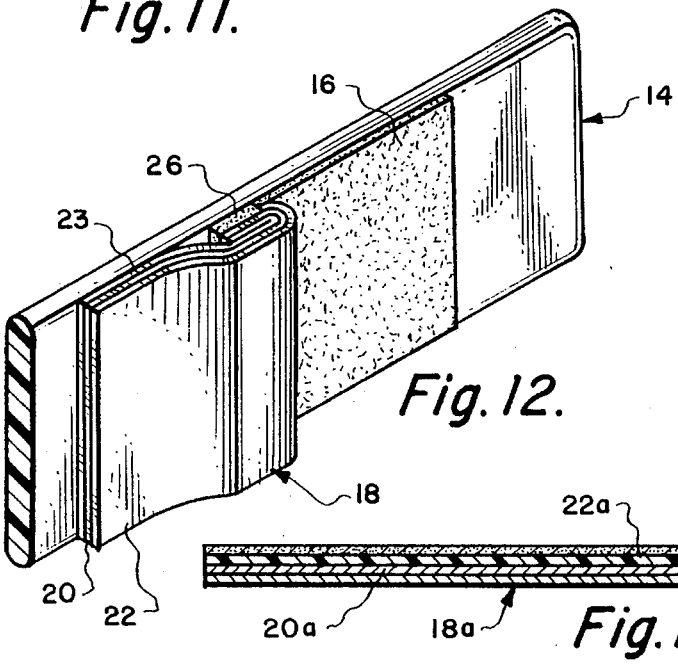
Figure 14:
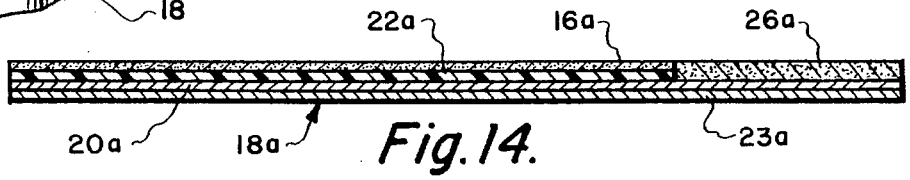

A preferred device for enabling the ready manufacture and assembly of the closure is illustrated in FIGS. 6 and 7, and a similar device is illustrated in FIG. 13 for an alternative embodiment including a permanent bonding strip 26. A continuous strip **18*a* of the liner cover is provided on a dispensing spool or reel 30. The spool may be mounted to dispense the strip 18*a* as part of a manufacturing process, such as by mounting the spool 30 on a bar 32 so it can rotate thereupon. An appropriate length of the strip 18*a* can be unwound from the spool 30, and then be severed (such as by cutting or by tearing along perforated dividing lines) from the strip 18*a* and affixed to one or more bracelets 10 in the relationship shown in FIGS. 1 and 2 (or FIGS. 9 and 10); that is, overlying the adhesive means 16**.

For ease of manufacture, the strip **18*a* can be applied to a plurality of bracelets simultaneously (or even to a sheet of material from which a plurality of bracelets will eventually be cut or formed), and the individual bracelets 10** subsequently cut or torn apart from each other.

Additionally, the adhesive 16 may be conveniently disposed on the non-adhesive layer 22 prior to assembly with the band 10. The adhesive 16 is thus "carried" on the non-adhesive layer 22 until being juxtaposed to the band 10, whereupon the adhesive is transferred to the band 10 by the application of pressure or other suitable means. Thereafter, the adhesive 16 is retained on the band 10 and may be exposed only as described above and as shown in FIGS. 3 and 4.

In FIGS. 6–8 and 13–14, the extension "-a" is applied to the various components of the continuous strip **18*a* as they correspond to the respective components in the remaining Figures. For example, the continuous strip of adhesive 16*a* (FIGS. 7–8) corresponds to the adhesive means 16 in FIGS. 2–5**.

Additionally, in order to permit the preferred spooling and dispensing of the continuous strip **18*a*, FIGS. 6–8 and 13–14, a non-adhesive coating 23*a* (designated as coating 23 in FIGS. 1–5 and 9–12) is preferably provided on the surface of the cover or shield means opposite the adhesive 16. The coating 23*a* is configured to prevent undesired adhesion of the adhesive means 16*a* to the surface 20*a* under the coating. This is especially beneficial, for example, to permit the desired dispense of the strip 18*a* from the spool or reel 30**.

Those skilled in the art will understand that, if an appropriate material **20*a* is utilized in manufacturing the bracelet (such as one having an appropriately non-adhesive surface already incorporated in the material), no separate coating 23*a*** would be necessary.

Thus, by my invention, I provide a simple and inexpensive construction of an improved adhesive closure for identification bracelets, which may be readily used in numerous applications with an improved ease of application and reduction of waste at the time of application.

The identification bracelet closure assembly of my invention has been described with some particularity but the specific designs and constructions disclosed are not to be taken as delimiting of the invention in that various modifications will at once make themselves apparent to those of ordinary skill in the art, all of which will not depart from the essence of the invention and all such changes and modifications are intended to be encompassed within the appended claims.

I claim:

1. In an identification bracelet, the combination of: band means for encircling relationship with an object to be identified, said band means having a first end and a second end located adjacent each other when said band means encircles said object; adhesive on said first end engagable with said second end to retain said band means in the encircling relationship; and shield means having a first portion having a bottom surface covered with a non-adhesive layer means, wherein the non-adhesive layer means directly engages the adhesive and allows for the first portion to be separated from said adhesive to prevent the permanent adhesion of the first portion to the adhesive, said shield means including a second portion having a bottom surface directly attached to said adhesive for permanently affixing the second portion to the adhesive, said shield means being foldable to release said first portion from said adhesive and expose said adhesive for securement of said second end to said first end, said first portion being folded internally of said band when said first and second ends are so secured.

2. The identification bracelet of claim 1, in which said shield means second portion is non-releasably affixed to said band means adjacent said adhesive by permanent adhesive.

3. An identification band with closure means having no disposable parts, including: band means having first and second ends adapted to be joined together to encircle an object to be identified; adhesive on said first end for securing said first and second ends when said ends are so joined together; and shield means having a first portion overlying said adhesive and having a bottom surface covered with a non-adhesive layer means, wherein the non-adhesive layer means directly engages the adhesive and allows for the first portion to be separated from the adhesive to prevent the permanent adhesion of the first portion to the adhesive and a second portion having a bottom surface directly attached to said adhesive permanent affixing the second portion to the adhesive, said first portion being movable from temporary overlying relationship with said adhesive to expose the same to secure said first and second ends together, said first portion being folded after said ends are secured and located inside said band means.

4. In an identification bracelet having first and second ends for encircling relationship with an object to be identified and securable in the encircling relationship by adhesive on said first end acting between said first and second ends; a cover for said adhesive having a first portion having a bottom surface, the bottom surface of said first portion being covered with a non-adhesive layer means, wherein the non-adhesive layer means directly engages the adhesive and allows for said first portion to be separated from said adhesive prior to the encircling of said object by said bracelet, said cover having a second portion having a bottom surface directly attached to said adhesive for permanently affixing the second portion to the adhesive, said first portion being foldable over said second portion to expose said adhesive to secure said ends.

* * * * *

UNITED STATES PATENT AND TRADEMARK OFFICE

CERTIFICATE OF CORRECTION

PATENT NO. : 5,457,906

DATED : October 17, 1995

INVENTOR(S) : Walter W. Mosher, Jr.

It is certified that error appears in the above-indentified patent and that said Letters Patent is hereby corrected as shown below:

column 2, line 46, add an--S--to "FIG."

column 2, line 46, add a comma after "respectively".

In the claims, column 6, line 14, after "adhesive", delete "permanent" and add--for permanently--.

Signed and Sealed this

Thirteenth Day of February, 1996

Bruce Lehman

*Attest:*

BRUCE LEHMAN

*Attesting Officer*

*Commissioner of Patents and Trademarks*